United States Patent [19]

Hogg

[11] Patent Number: 4,524,939

[45] Date of Patent: Jun. 25, 1985

[54] DOUBLE PRONGED FASTENER WITH PARTIALLY DELAMINATED ADHESIVE LAYER

[75] Inventor: James W. Hogg, Nashville, Tenn.

[73] Assignee: Anchor Wire Corporation, Goodlettsville, Tenn.

[21] Appl. No.: 352,188

[22] Filed: Feb. 25, 1982

Related U.S. Application Data

[63] Continuation-in-part of Ser. No. 97,145, Nov. 26, 1979, Pat. No. 4,317,555.

[51] Int. Cl.[3] ..... A47F 7/14

[52] U.S. Cl. ..... 248/467; 248/216.1

[58] Field of Search ..... 248/205 A, 216.1, 467, 248/489; 410/458, 460; 403/267

[56] References Cited

U.S. PATENT DOCUMENTS

| | | | |
|---|---|---|---|
| 417,805 | 12/1889 | Beaman | 248/489 X |
| 920,236 | 5/1909 | Albee | 248/467 |
| 1,177,106 | 3/1916 | Hickerson et al. | 411/460 X |
| 1,297,584 | 3/1919 | Mock | 411/458 |
| 1,413,833 | 4/1922 | David | 248/489 X |
| 1,496,282 | 6/1924 | Taylor | 248/467 |
| 1,560,029 | 11/1925 | Erickson | 248/205 A |
| 2,061,372 | 11/1936 | Wallin | 248/467 |
| 3,482,809 | 12/1969 | McCall | 248/205 A |
| 3,633,865 | 1/1972 | Hogg | 248/467 |
| 4,317,555 | 3/1982 | Hogg | 248/467 |

*Primary Examiner*—William H. Schultz

*Attorney, Agent, or Firm*—Fisher, Christen & Sabol

[57] ABSTRACT

A fastener for hanging an object such as a picture, or a plaque, on a vertical surface such as a wall of plaster or wallboard is formed by attaching a narrow flat strip of metal to a small piece of sheet metal so as to project outwardly at right angles to the small sheet, the ends of the strip being sharpened to provide prongs to be inserted respectively into the wood frame of the object to be hung and into the wall. The side of the small sheet facing the wall is covered with a sheet of partially delaminated paper, or similar material, which is coated on its exposed surface with a soluble adhesive which is moistened at the time of use to cause the fastener to adhere to the wall. The fastener can be withdrawn by completing the delamination of the paper and soaking the residue on the wall with liquid.

16 Claims, 5 Drawing Figures

FIG. 1
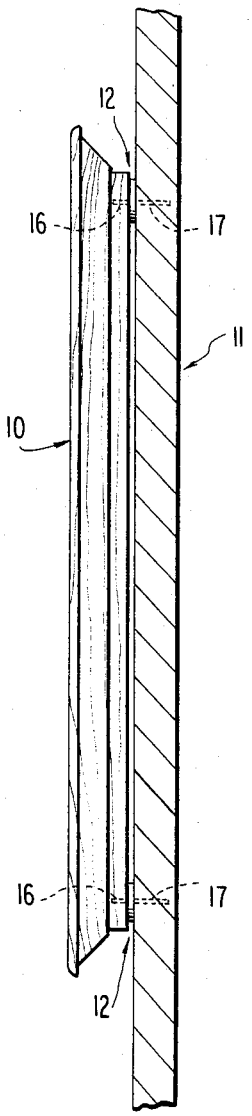
FIG. 2
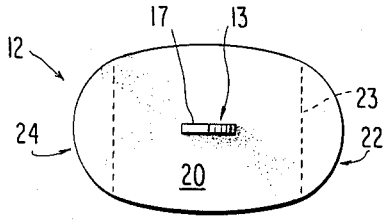
FIG. 3
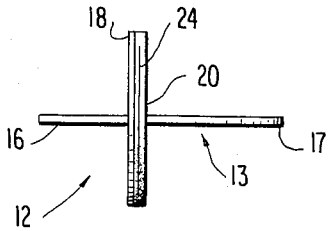
FIG. 4
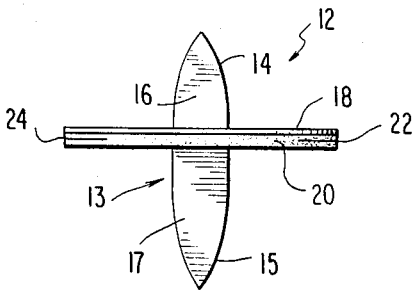
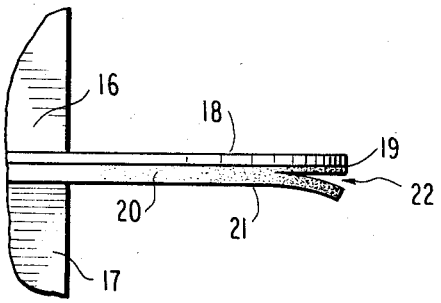
FIG. 5

DOUBLE PRONGED FASTENER WITH PARTIALLY DELAMINATED ADHESIVE LAYER

CROSS REFERENCE TO ANOTHER APPLICATION

This application is a continuation-in-part of my prior copending application Ser. No. 97,145, filed Nov. 26, 1979 now U.S. Pat. No. 4,317,555.

BACKGROUND OF THE INVENTION

This invention relates to a fastener of the type that can be used to hang a light picture, plaque or other similar object from a wall and more particularly to the type of fastener having a body formed by a flat strip of material, such as metal, from both sides of which there projects a sharpened pin, or nail. One of the sharpened objects is pushed into the frame of the object to be hung and thereafter, by pushing the frame containing the inserted pin into the wall, the object is to be supported with the flat body interposed between the wall and frame. Fasteners of this general type are disclosed in U.S. Pat. Nos. 417,805; 1,177,106 and 1,023,502.

In another variation the oppositely projecting sharpened elements may be supported by a relatively thick body which holds the frame outwardly from the wall. Other variants include the use of a pin having a threaded shank to assist in holding it in place, or forming the element in the form of a triangular flat prong designed to be inserted into either the frame, or the wall, or both, in a horizontal plane to increase the weight carrying capacity. In other instances, when the sharpened pins are used, the body may be designed to hold them at an angle to the horizontal to increase the weight-carrying capacity. Typical examples are disclosed in U.S. Pat. Nos. 1,675,282; 1,413,833; 1,314,548; 1,297,584 and 1,901,644.

In another example, the flat body is attached to the frame by means of an adhesive and a flat prong, or sharpened pin projects from only one side to be pushed into the wall, as in U.S. Pat. Nos. 2,061,372 and 920,236.

A disadvantage of all of the fasteners disclosed in the patents mentioned above is that, while metal pins, or flat prongs, when embedded in the wood frame of a picture, or other object be hung, will remain in place and resist removal, they are relatively ineffectual when inserted in a horizontal direction into a wall made of plaster or the more common gypsum board. Because of wallboard and plaster's granular interior composition most of the hangers used in wall board, or plaster are driven in at an angle to counteract forces which might tend to cause their removal. Unfortunately, this means that the hanger must be put in place first and it is difficult to insert the pin, or prong, at the proper location prior to hanging the picture, to say nothing of the fact that it is difficult to drive a nail, or pin into a wall at the exact location desired when it is being driven in at an oblique angle to the wall surface.

An attempt to overcome this difficulty is made in U.S. Pat. Nos. 3,300,173 and 2,723,815 which each discloses a sort of "nail jig" comprising a body which is first attached to the wall by means of a pressure sensitive adhesive. This body is provided with a central opening arranged at the proper angle to the wall and through which the nail, or pin, is then driven into the wall. However, the fastener in both of the last-mentioned patents are merely hooks to support a picture wire, or the like.

BRIEF SUMMARY OF THE INVENTION

The fastener of this invention takes advantage of the fact that the problem involves the uniting of two dissimilar materials, namely a wood picture frame with a plaster or gypsum wallboard in a jointure that over a long, or short, period of time may turn out to be temporary. That is to say in today's mobile population occupants of houses, even if they own them are frequently transferred to other locations. This means that, while the rooms occupied are decorated with furniture and wall hangings with a sense that they are permanent, it frequently turns out that they must be removed when it comes time to go to another location.

With respect to the prior fasteners, a disadvantage is that not only is it difficult to drive a nail, or pin, into a wall at an angle at the correct location to provide proper support but it is also difficult to remove such a nail or pin without destroying some of the surrounding wallboard or plaster. Often, the choice is to leave the fastener in the wall, which is even more unsightly.

On the other hand, if a nail, or pin, is driven into wallboard, or plaster, at right angles its weight-supporting power is increased because the force of the supported object will pull the nail, or pin, downwardly at right angles to the hole and the granular compressed materials near the surface are more effectively utilized.

It is therefore an object of this invention to provide a fastener having a generally oval shaped flat metal body having a pair of prong-shaped, or spade-like, elements projecting outwardly at right angles from each side of the body for the purpose of inserting one of the prongs into the wood frame of a picture, or similar article, after which when the exact position of the picture has been determined, the other prong may be pushed into the supporting wall at right angles to the surface thereof.

It is a further object that the prong-shaped element that is driven into the wall be disposed that its flat surfaces lie in a horizontal plane to provide maximum weight-supporting capacity for the size of the opening made in the wall.

It is further contemplated that by applying a partially delaminated adhesive backing sheet, of the type described and claimed in my prior application Ser. No. 97,145, to the surface of the flat body facing the wall not only will the flat prong inserted into the wall be retained in place for as long as is necessary but, if it becomes necessary the prong may be removed with no damage to the wall other than the small slit originally made by the insertion of the prong. Because the wedge shape of a prong has an exposed surface of progressively decreasing area towards its pointed end, once any retractive movement begins, there is progressively less surface contacted between the prong and the interior recess in the wall than in the case of an object of uniform cross section, such as a nail.

The reason for this is that the said backing sheet is made of a water degradable material so that when the partial delamination is completed by removal of the fastener from the wall, none of the wall surface, including any decorative wall paper applied to the wall, will be pulled off. Instead, the partially delaminated portion of the backing strip remains on the wall surface and can be easily removed by soaking it with water.

A further advantage of the invention is that by using a spade-shaped or prong-like, element on the side of the fastener body away from the wall this element may be pushed into a wood frame member with its flat surface running in the direction of the wood grain thus minimizing the danger of splitting the wood or weakening the wood by cutting across the grain while affording the maximum frictional engagement for the size of the opening made in the wood. The load-bearing ability is increased because the flat surface lies in a plane perpendicular to the direction of force.

BRIEF DESCRIPTION OF THE DRAWINGS

FIG. 1 is a side elevation of a wood picture frame supported in a section of a plaster or gypsum wallboard by means of fasteners made in accordance with the teachings of their invention;

FIG. 2 is a rear elevation of a fastener shown in FIG. 1, on a greatly enlarged scale;

FIG. 3 is a side elevation as viewed from the left in FIG. 2;

FIG. 4 is a plan view of the fastener of FIG. 2;

FIG. 5 is a detailed view, on a further enlarged scale, of one end of the body of the fastener in FIG. 4 showing the partial delamination of the basking strip.

DETAILED DESCRIPTION OF THE INVENTION

In the drawings the numeral 10 indicates generally an object such as a light picture, plaque or similar object, that is to be hung on a wall, indicated generally by numeral 11 by means of a plurality of fasteners, indicated generally by numeral 12, of the type disclosed and claimed in this application.

Each of the fasteners 12 comprises an elongated flat strip of metal, indicated generally by numeral 13 in FIG. 4, the opposite ends of which are tapered at 14 and 15 to provide oppositely projecting prongs 16 and 17. The fasteners also includes a transverse sheet 18, preferably made of a rigid material such as metal, having a central slit through which the metal strip 13 passes. The two prongs 16 and 17 are disposed so as to project outwardly from the opposite sides of the metal sheet 18 and substantially perpendicularly with resepct thereto, and is firmly fixed in place, as by soldering or spot welding. Preferably the metal sheet 18 is oval in outline and the flat metal strip 13 is disposed in a plane in alignment with the major axis of the oval defining the margins of sheet 18. Furthermore, for reasons that will become apparent later, it is desirable for one of the prongs 17, for example, to project outwardly from sheet 18 for a greater distance than the prong 16.

To one side of the metal sheet 18 there is attached, as by means of a layer of adhesive 19, a sheet of water degradable material 20 having generally the same configuration as that of the metallic sheet 18. The exposed surface of sheet 20 is covered with a layer of remoistenable adhesive 21 and along a portion of the margin of said sheet there is an internally directed incision, indicated generally by numeral 22 in FIG. 5, extending in a plane parallel with the two opposite exterior surfaces of sheet 20, the internal limit of said incision being indicated by the dotted line 23 in FIG. 2. A similar incision 24, of greater or less depth, may also be made in the opposite margin of fibrous sheet 20. The partially delaminated sheet 20 is more fully described and claimed in my aforementioned application, Ser. No. 97,145.

In order to make the most advantageous use of this fastener it is desirable to position the prongs 16 and 17 so that they lie in a horizontal plane. Furthermore, since the holding power of a round nail, or flat prong is greater when inserted into wood than into the cementitious material of which the ordinary wall, or wallboard is composed, it is preferable to first insert the shorter of the two prongs 16 of each of the fasteners 12 into the wood frame members at the top and bottom of the article, or object, to be hung. In this way the prongs will lie in alignment with the grain of the wood to minimize splitting or cutting of the wood fibers and the flat surfaces of the prongs will be disposed perpendicular to the forces of gravity.

Furthermore, a characteristic of wood is that its grain structure has a slot of "memory" in the sense that when the fibers are merely split apart, rather than transversely severed, they tend to return to their original positions thus increasing their holding pressure on the flat sides of a prong.

In this connection it may be noted that an especial advantage of the invention is that if a picture is not likely to be disturbed other than by wall vibration, only a single fastener is necessary because the flat prong will prevent the picture from swinging to one side or the other.

After the prongs 16 have been inserted in the wood, the adhesive layer 21 on the delaminated sheet 20 is first moistened and the object 10 can be located at the exact location when it is to be located on wall 11. Pressure is then exerted from the front of the frame members at each spot where a fastener 12 is located and the longer of the two prongs 17 is pushed into the wall as far as it will go to bring the adhesive 21 in contact with the wall surface. Pressure is maintained thereafter for only a sufficient amount of time to allow the adhesive to set and bond the sheet 20 to the exterior surface of wall 11.

When it becomes necessary to remove the object 10 from the wall it will only be necessary to first pull the wood frame of the picture, or object, directly forwardly away from the wall. The grip of the wood frame members on the prongs 16 will be sufficient to pull the other prongs 17 out of their recesses in the wall and, at the same time, the delamination of sheet 20 will be completed, as explained in application Ser. No. 97,145, leaving a thin layer of fibrous material from sheet 20 still adhering to the wall. This thin residual layer can then easily be removed by soaking it in water with a sponge and light rubbing.

While the fastening of this invention is primarily intended for use in mounting objects on walls made of plaster or wallboard, it is equally suitable for plywood panelled walls. For that reason, it is preferable to form the prong 17 with uniform width along that portion of its length adjacent the sheet 18 to take advantage of the so-called "memory" gripping effect of the wood fibers.

What I claim is:

1. Fastener for mounting an object having a wood member on a wall comprising plaster, or gypsum, wallboard or the like, comprising:

a flat sheet of metal;

a sheet of liquid degradable, partially delaminated fibrous material bonded to one side of said metal sheet to form a composite of sheet metal and fibrous material the exposed surface of said fibrous sheet being coated with a soluble adhesive;

a pair of flat metal prongs projecting outwardly from respective opposite sides of said composite of sheet metal and fibrous sheet material and at right angles thereto;

the free ends of said prongs being sharply pointed to facilitate insertion respectively into wood material and into a wall.

2. Fastener according to claim 1, wherein the prong to be inserted into a wall is substantially longer in length than the other of the pair of prongs.

3. Fastener according to claim 2, wherein the prong to be inserted into a wall is substantially uniform in width along at least a portion of its length.

4. Fastener according to claim 3, wherein the prong to be inserted into a wood member is tapered along substantially its entire length.

5. Fastener according to any one of claims 1, 2, 3 or 4, wherein said pair of prongs are formed from a single piece of flat strip metal.

6. Fastener according to any one of claims 1, 2, 3 or 4, wherein both of said prongs are disposed in the same plane.

7. Fastener means for attaching an object to a wall including plaster, gypsum, wallboard, or the like, comprising:

an elongated narrow flat metal prong, both ends of said prong being tapered to provide sharpened ends;

one end of said prong adapted to be forcibly inserted into a wood frame member;

the other end of said prong to be forcibly inserted into a wall at right angles to the surface thereof;

said prong being provided with securing means for holding said other end of the prong in place in the wall;

said securing means being liquid degradable to permit forcible removal of said other end of the prong without destruction of the surrounding wall surface.

8. Fastener means according to claim 7, wherein said securing means comprises a liquid-degradable fibrous sheet and a metal sheet adhesively bonded to said fibrous sheet and being fixedly attached to said metal strip defining said prong.

9. Fastener means according to claim 8, wherein said metal sheet is co-extensive in area with said fibrous sheet.

10. Fastener means according to claim 9 wherein said metal and fibrous sheets have a substantially greater dimension in one linear direction than in a linear direction normal to said first direction.

11. Fastener means according to any one of claims 7, 8, 9 or 10 wherein said fibrous sheet is oval in outline, the major axis of said oval being disposed generally in the plane of the flat strip defining the prong.

12. Fastener means according to claim 11 wherein the surface of said fibrous sheet to be placed in contact with a wall is coated with a layer of soluble adhesive.

13. Fastener means according to claim 12 wherein said adhesive is soluble in water.

14. Fastener means according to any one of claims 7, 8, 9 or 10 wherein the length of the portion of the prong adapted to be inserted into a wall is substantially greater than the length of the portion of the prong adapted to be inserted into a wood member.

15. Fastener means according to claim 14 wherein a portion of the prong adapted to be inserted into a wall is substantially uniform in width.

16. Fastener means according to claim 14 wherein the length of the portion of the prong adapted to be inserted into a wall is approximately twice the length of the portion of the prong adapted to be inserted in a wood member.

* * * * *